United States Patent [19]

Manty

[11] 4,026,734

[45] May 31, 1977

[54] METHOD OF COATING TITANIUM

[75] Inventor: Brian A. Manty, Lake Park, Fla.

[73] Assignee: The United States of America as represented by the Secretary of the Air Force, Washington, D.C.

[22] Filed: Jan. 16, 1976

[21] Appl. No.: 649,762

[52] U.S. Cl. ..... 148/6.15 R; 148/6.3; 148/31.5

[51] Int. Cl.[2] ..... C23F 7/14; C23F 7/06

[58] Field of Search ..... 148/6.15 R, 6.3

[56] References Cited

UNITED STATES PATENTS 3,615,912 10/1971 Dittel et al. ..... 148/6.15 R

OTHER PUBLICATIONS

Miller et al., Metal Progress, May 1956 pp. 61–64.

*Primary Examiner*—Ralph S. Kendall

*Attorney, Agent, or Firm*—Joseph E. Rusz; William J. O'Brien

[57] ABSTRACT

A process for treating the surfaces of a titanium or titanium alloy article which comprises immersing the titanium article in an aqueous solution of ammonium phosphate and then oxidizing the surface by heating the coated article at a temperature of about 800° F for about 20 hours.

1 Claim, No Drawings

METHOD OF COATING TITANIUM

STATEMENT OF GOVERNMENT INTEREST

The invention described herein may be manufactured and used by or for the Government for governmental purposes without the payment of any royalty thereon.

BACKGROUND OF THE INVENTION

This invention relates generally to a method for coating titanium and titanium base alloys. More particularly, this invention is concerned with providing protection for titanium and titanium alloys against the degradative effects of corrosion under stress conditions.

The recent advent of high altitude and high speed aircraft and missiles has created a need for materials which exhibit high strength and high resistance to oxidative and corrosive degradation at elevated temperatures. The need for such materials becomes even more acute when one considers the great strains and stresses produced in structural elements during operation within a high speed, high altitude environment. Titanium and titanium alloys are well known for their corrosive resistance and find their main application in the aircraft industry, where high strength, coupled with light weight, is a design criteria. These materials, however, do not possess sufficient stress corrosion resistance to meet the demands of present day aircraft and missiles.

In attempting to overcome this problem and provide titanium elements with a high degree of stress corrosion protection without mechanical property degradation, it has been found that immersing a titanium element into an aqueous solution of amonium phosphate followed by the step of heating the element provides a coated element which exhibits improved resistance to stress corrosion cracking.

SUMMARY OF THE INVENTION

In accordance with this invention, stress corrosion resistance can be imparted to titanium and titanium alloy articles by a coating process which comprises immersing the titanium article in an aqueous solution of ammonium phosphate in a vacuum chamber, pulling a vacuum over the article in said solution, releasing the vacuum, removing the article and draining the excess solution therefrom, placing the coated article in an oven to heat it at 800°F, and then removing the article from the oven. The resulting coated titanium article possesses a high degree of resistance to stress corrosion because of the formation of a phosphate doped oxide coating on the surface of the article.

Accordingly, the primary object of this invention is to provide a coating for titanium articles which gives good stress corrosion protection without mechanical property degradation.

Another object of this invention is to provide a stress corrosion resistant coating process that is adaptable for application to both exterior and interior surfaces of titanium articles.

The above and still other objects and advantages of the present invention will become more readily apparent upon consideration of the following detailed description thereof.

DESCRIPTION OF THE PREFERRED EMBODIMENT

The present invention is predicated upon the discovery that a phosphate doped oxide coating on the surface of a titanium or titanium based alloy imparts a high degree of stress corrosion protection to a titanium article. The coating is produced by a process in which the titanium metal surface is wetted with a solution containing phosphorous and then oxidized. The procedure has been used to produce specimens, which preliminary salted stress rupture testing indicates, improves the specimens resistance to stress corrosion cracking.

The invention forms, at least in theory, what is believed to be a phosphate impregnated oxide of titanium operating through a "space charge" mechanism that provides a barrier to penetration and thus prevents stress corrosion. The coating is applied to a titanium article by wetting its surface with a solution containing phosphorous, and then heating so that a phosphate doped oxide is obtained.

The novel features of this invention are set forth in the appended claims. However, the invention may be better understood by referring to the following which describes in detail an example of the method of this invention. A titanium article of conventional structure is immersed into a 5 percent by weight aqueous solution of ammonium phosphate positioned within a vacuum chamber. A vacuum of from 28 to 30 inches of mercury is pulled over the system. The vacuum is released while the titanium article remains in the phosphate solution. The article is then removed and excess solution is allowed to drain off. The article is then placed in an oven and heated to a temperature of about 800°F for a period of about 20 hours. The article is then removed from the oven and allowed to cool to room temperature.

The above procedure provides a phosphate doped oxide coated substrated with useful engineering properties. The modified titanium substrate is highly resistant to salt penetration and stress corrosion. The coating can be applied to any structure composed of titanium or titanium based alloys.

Although the present invention has been described with reference to a specific embodiment, those skilled in the art will readily understand that various modifications and alterations thereof may be resorted to without departing from the spirit of the invention, and that all such modifications as fall within the scope of the appended claims are intended to be included herein.

What is claimed is:

1. A method for imparting stress corrosion resistance to titanium articles which comprises the steps of immersing the said article into an aqueous solution of ammonium phosphate within a vacuum environment to effect the wetting of the surface of said article; removing said wetted article from said vacuum environment and heating said wetted article to a temperature of about 800° F for a period of about 20 hours to produce a phosphate doped oxide coating on the surface of said article.

* * * * *